US007832385B1

(12) United States Patent
Kapinski et al.

(10) Patent No.: US 7,832,385 B1
(45) Date of Patent: Nov. 16, 2010

(54) RIPPLE REDUCTION IN ELECTROMAGNETIC LAUNCHER CURRENT FROM PULSED ALTERNATORS

(75) Inventors: James Patrick Kapinski, Pittsburgh, PA (US); David Jonathan Hall, Pittsburgh, PA (US); Dennis Pavlik, Pittsburgh, PA (US); Thomas Andrew Lemak, McKeesport, PA (US)

(73) Assignee: Curtiss-Wright Electro-Mechanical Corporation, Cheswick, PA (US)

( * ) Notice: Subject to any disclaimer, the term of this patent is extended or adjusted under 35 U.S.C. 154(b) by 0 days.

(21) Appl. No.: 11/954,880

(22) Filed: Dec. 12, 2007

(51) Int. Cl.
*F41F 1/00* (2006.01)

(52) U.S. Cl. ..... 124/3; 89/8

(58) Field of Classification Search ..... 322/45; 124/3; 89/8

See application file for complete search history.

(56) References Cited

U.S. PATENT DOCUMENTS

| | | | | |
|---|---|---|---|---|
| 4,836,083 | A * | 6/1989 | Triezenberg | 89/8 |
| 4,928,572 | A * | 5/1990 | Scott et al. | 89/8 |
| 5,182,464 | A | 1/1993 | Woodworth et al. | |
| 5,550,455 | A | 8/1996 | Baker | |
| 5,555,182 | A | 9/1996 | Galm | |
| 5,808,378 | A | 9/1998 | O'Leary | |
| 6,281,664 | B1 | 8/2001 | Nakamura et al. | |
| 6,534,960 | B1 * | 3/2003 | Wells et al. | 323/222 |
| 7,102,331 | B2 | 9/2006 | Walter et al. | |
| 7,116,082 | B1 * | 10/2006 | Baumgart | 322/45 |
| 7,357,128 | B1 * | 4/2008 | Baumgart | 124/3 |
| 7,409,900 | B1 * | 8/2008 | Nechitailo et al. | 89/8 |
| 7,431,237 | B1 * | 10/2008 | Mock et al. | 244/3.24 |
| 7,730,821 | B2 * | 6/2010 | Taylor | 89/8 |

FOREIGN PATENT DOCUMENTS

| | | |
|---|---|---|
| JP | 2001-111086 | 4/2001 |
| JP | 2003-52165 | 2/2003 |

OTHER PUBLICATIONS

Crawford, M. et al., "Use of Saber Circuit Simulation Software for the Modeling of Compensated Pulsed Alternators Driving a Railgun Load," IEEE Transactions on Magnetics, vol. 39, No. 1, Jan. 2003, pp. 337-342.

Kitzmiller, J.R. et al., "An Application Guide for Compulsators," IEEE Transactions on Magnetics, vol. 39, No. 1, Jan. 2003, pp. 285-288.

Kitzmiller, J.R., et al., "Final Design of an Air Core, Compulsator Driven, 60 Caliber Railgun System," IEEE Transactions on Magnetics, vol. 27, No. 1, Jan. 1991, pp. 50-55.

Burgess, R. R., "The Mach 7 Munition," Sea Power Magazine, Oct. 2005, pp. 28-30, published by the Navy League of the United States.

* cited by examiner

*Primary Examiner*—Michael Carone
*Assistant Examiner*—Reginald Tillman, Jr.
(74) *Attorney, Agent, or Firm*—Reed Smith LLP

(57) ABSTRACT

Systems and methods for improving the current pulse from multiple pairs of pulsed alternators used for driving large loads such as an electromagnetic launcher (i.e., "rail gun") load. Conventional current pulse ripples are reduced by interleaving pulses from multiple pairs of contra-rotating pulsed alternators. Current pulses supplied by different pairs of pulsed alternators are timed so that they are interspersed between one another to provide more pulses for a given launch time. The interleaved current pulses increase the frequency and reduce the magnitude of the ripple on the average load current.

17 Claims, 3 Drawing Sheets

RIPPLE REDUCTION IN ELECTROMAGNETIC LAUNCHER CURRENT FROM PULSED ALTERNATORS

STATEMENT OF GOVERNMENT INTEREST

The United States Government may have certain rights in the present invention pursuant to Contract No. N000014-06-D-0046 with the Department of Defense and the United States Navy (DoD/Navy).

BACKGROUND OF THE INVENTION

1. Field of the Invention

The present invention relates generally to pulsed alternator current sources, and, more particularly, the present invention is directed to systems and methods for utilizing multiple pairs of pulsed alternators with an interleaved pulse control mechanism to drive large electromagnetic launcher loads.

2. Description of the Background

It is well known in the art that specialized rotating generators can be used to store kinetic energy and convert it to high current electrical energy in the millisecond time frame. Such generators, called pulsed alternators can be used to drive electromagnetic launcher loads that are used to propel a projectile or other object along an intended path. One application of these launchers is for high-energy electromagnetic launchers in the form of "rail guns." These rail guns use a pulsed power system to launch a projectile very long distances with a high degree of accuracy and are especially suited for mobile design (onboard a ship or mobile gun turret).

The pulsed alternator's high degree of rotating stored energy and extreme torques generated during discharge mandate that a torque and inertia management scheme be employed to control the reaction transmitted to the system base structure. To address the high torque of these large machines, pairs of pulsed alternators with contra-rotating rotors are used to mitigate the reaction torque effects. By spinning in opposite directions, the torque from each pulsed alternator tends to cancel each other and the total torque on the system base structure approaches a negligible value.

Therefore, when used as pulsed power sources, pulsed alternator systems are configured with single or multiples pairs of contra-rotating machines (generators). The more pairs of machines that are used, the higher the amount of energy that can be stored and subsequently released. For high-energy applications such as a rail gun, several pairs of pulsed alternators may be needed. The present invention is most pertinent to pulsed power sources in which multiple pairs of pulsed alternators are utilized.

In multiple alternator systems, each of the pulsed alternators is characterized by an AC (alternating current) output. In conventional pulsed alternator systems, the AC generator outputs are rectified with identical gating pulses sent to the rectifier switches for each rotating machine. Such an identical gating scheme causes each of the pulsed alternators to be in phase. Therefore, the current pulses from each machine add together in phase to produce a DC (direct current) current pulse. Likewise, in conventional systems with multiple pairs of pulsed alternators, all rectifier switches for each output are identically controlled, and current from all the machines would be added together in phase. While such a gating scheme allows all of the output current from each of the alternators to be added together for the highest possible output current, it also produces a typical load current pulse with a "ripple" as shown in FIG. 1.

Ideally, the high-energy electromagnetic launcher load requires a smooth DC current pulse with as little ripple as possible (e.g., a square wave). Pulsed power sources including multiple pairs of pulsed alternators that can reduce or eliminate this unwanted ripple are continually sought in the art. The present invention, through its disclosed embodiments, addresses one or more of the above-described limitations of the prior art to provide a pulsed power source with improved output current characteristics.

SUMMARY OF THE INVENTION

There is broadly contemplated herein, in accordance with at least one presently preferred embodiment of the present invention, a pulsed power system, comprising: a first pair of pulsed alternators; at least a second pair of pulsed alternators; and a control system that combines a first current output from the first pair of pulsed alternators with a second current output from the second pair of pulsed alternators into a load current; wherein the first current output and the second current output are interleaved with each other in the load current.

Further, there is broadly contemplated herein, in accordance with at least one presently preferred embodiment of the present invention, an electromagnetic rail gun comprising: two gun rails; a projectile slidingly engaged between the rails; a first pair of pulsed alternators; at least a second pair of pulsed alternators; and a control system that combines a first current output from the first pair of pulsed alternators with a second current output from the second pair of pulsed alternators into a load current applied to the rails; wherein the first current output and the second current output are interleaved with each other in the load current.

In addition, there is broadly contemplated herein, in accordance with at least one presently preferred embodiment of the present invention, a method of generating pulsed power, the method comprising the steps of: generating a first pulsed current output; generating a second pulsed current output; and combining the first current output with the second current output into a load current, wherein the first current output and the second current output are interleaved with each other in the load current.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

Figure 1:
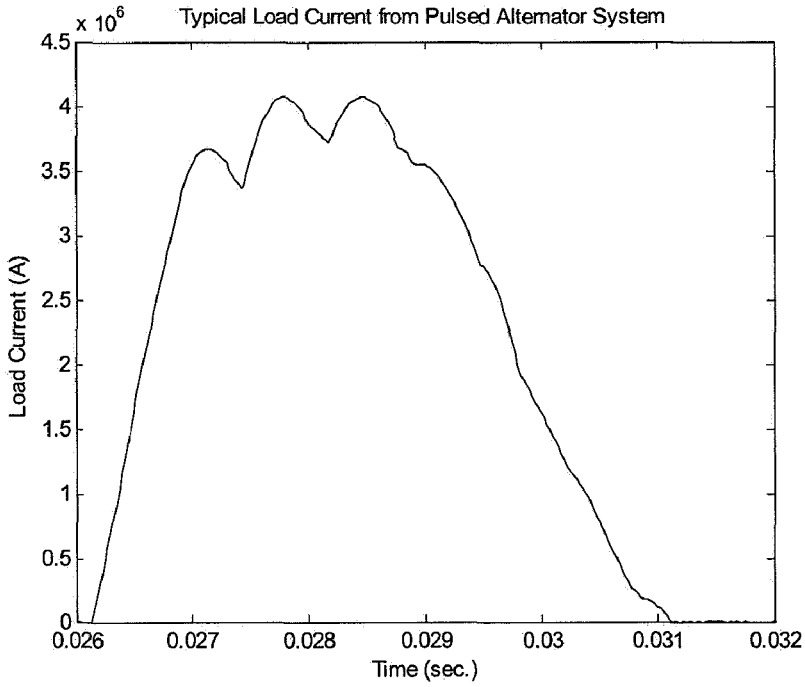
FIG. 1 is a graph of a typical load current pulse from a conventional pulsed alternator system (prior art)

It is to be understood that the figures and descriptions of the present invention have been simplified to illustrate elements that are relevant for a clear understanding of the invention, while eliminating, for purposes of clarity, other elements that may be well known. Those of ordinary skill in the art will recognize that other elements are desirable and/or required in order to implement the present invention. However, because such elements are well known in the art, and because they do not facilitate a better understanding of the present invention, a discussion of such elements is not provided herein. The detailed description will be provided herein below with reference to the attached drawings.

The present invention, in at least one preferred embodiment, provides systems and methods for controlling the current output of a pulsed power source including multiple pairs of pulsed alternators. Through the selective triggering of the outputs of the various different pulsed alternators, the unwanted "ripple" in the load current can be reduced or eliminated. Such a ripple drastically reduces the ability to control the output current which renders the pulsed power source non-ideal when used to control an electromagnetic launcher such as an electromagnetic rail gun.

The theoretical physics underpinning an electromagnetic launcher such as a rail gun are readily known, although practical applications of such a system are only now coming to fruition. In essence, a projectile is made to accelerate down the long axis of two or more rails until it escapes from the gun barrel. The acceleration is imparted on the projectile from firing one or more high current pulses down the rails to "push" the projectile out of the barrel. In order to accelerate a large projectile to a high velocity, the current pulses must be very large. However, in order to control the flight path and landing area of the projectile, the current must also have a very tight tolerance.

In more detail, for a rail gun to be effective, the projectile must be accelerated to a high velocity with a large amount of kinetic energy. The accuracy of the rail gun as an artillery device depends upon the precise control of the projectile muzzle velocity ($v_m$). For a general rail gun application, it will additionally be preferred to control the discharge of multiple projectiles in rapid succession.

The rail gun system generally comprises several components that perform these critical functions. A device or subsystem is provided to generate a specified large amount of energy prior to a discharge sequence (e.g., the pulsed alternators). Another device or subsystem is then provided to control the delivery of the energy from the source to the rail gun. The large discharge current delivered to the rails forms orthogonal magnetic and electric fields that expand behind the projectile and forces the projectile to accelerate over the length of the rails to the gun muzzle. Additional information about such a general rail gun is set forth in U.S. patent application Ser. No. 11/084,226 entitled "Closed Loop Defined Profile Current Controller For Electromagnetic Rail Gun Applications" which was filed on Mar. 17, 2005 and is incorporated herein by reference in its entirety.

As set forth above, to generate the large current pulses needed for an electromagnetic launcher, a specialized generator known as a pulsed alternator is most applicable. The pulsed alternator is characterized by a high rotating stored energy (compared to other generators) and large rotational torques. However, this high rotating stored energy and the extreme torques generated during discharge mandate that a torque and inertia management scheme be employed to control the reaction transmitted to the system base structure. A specialized pulsed power system is therefore employed.

Figure 2:
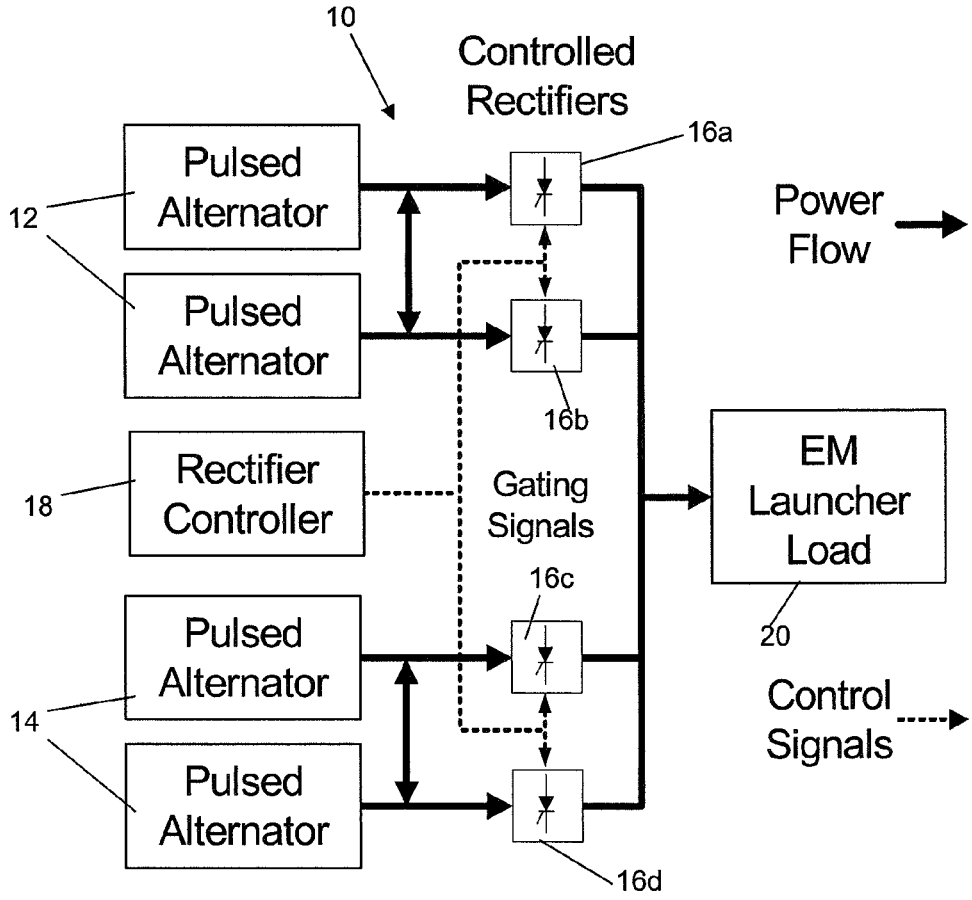
FIG. 2 depicts a diagram of a system with two pairs of pulsed alternators working in conjunction as a pulsed power source.

FIG. 2 depicts a diagram of a pulsed power system (10) to apply a current pulse to an electromagnetic load. As described above, pairs of alternators with contra-rotating rotors mitigate the reaction torque effects by spinning in opposite directions. Therefore, pulsed alternator systems are configured with single or multiple pairs of contra-rotating machines. The system of FIG. 2 includes two pairs (12, 14) of matched pulsed alternators. Each pair (12, 14) of alternators preferably sit side by side and counter rotate during operation, which allows the torques produced by the machines within a pair (12, 14) to negate each other. The outputs of each pair of pulsed alternator machines (12, 14) are then electrically interconnected to each other (as shown by the two-way arrows).

Also, the individual outputs of each machine are connected to controlled rectifiers 16*a*/16*b*/16*c*/16*d*, which are also referred to as a load converter. The controlled rectifiers 16*a-d* convert the machine's AC outputs to DC. The FIG. 2 system also includes a rectifier controller (18) which provides appropriate gating pulses to activate the rectifier switches (controlled rectifiers 16*a-d*) at precise times. The outputs of the four rectifiers 16*a-d* are connected together and are fed to the breech-end of the electromagnetic launcher (20). FIG. 2 also illustrates the general power flow in the system.

In existing pulsed alternator systems, the AC generator outputs are rectified with identical gating pulses sent to the rectifier switches (controlled rectifiers) for each pulsed alternator machine. Such a synchronized system adds the current pulses from each machine together in phase to product a DC current pulse. In systems with multiple pairs of machines such as that shown in FIG. 2, all rectifier switches are identically controlled and current from all the machines is added together in phase. This produces a typical load current pulse with a ripple as shown in FIG. 1 and described above. Ideally, the high-energy electromagnetic launcher load requires a smooth DC current pulse with as little ripple as possible.

Figure 3:
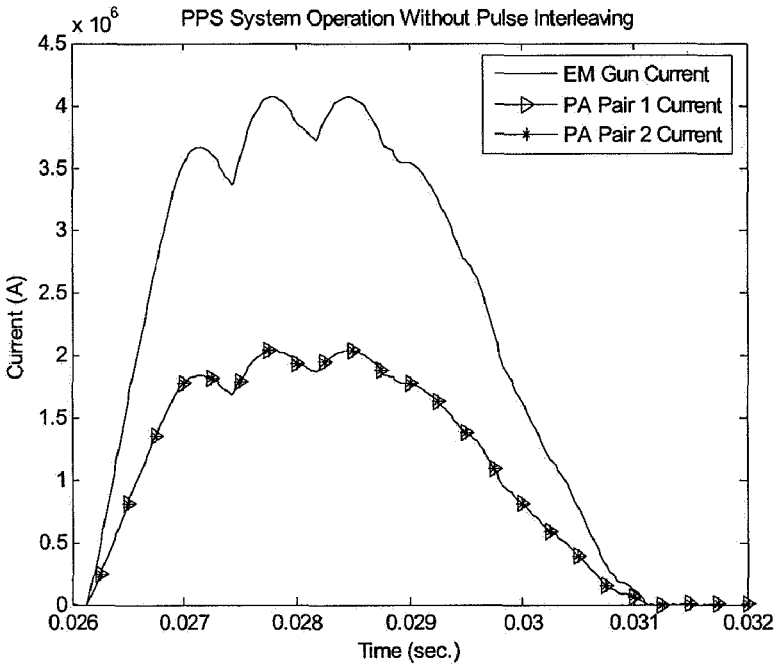
FIG. 3 is a graph of the load and individual pulsed alternator pair currents utilizing a conventional control scheme with synchronized output gating.

In more detail, FIG. 3 shows the simulated load current pulse from a conventional two-pair pulsed alternator system with identical gating signals supplied to all four-load converters. At the lower portion of the figure, the output current from each of the two pairs of pulsed alternators (PA Pair 1 Current, PA Pair 2 Current) is depicted. Note that each of the pairs of pulsed alternators is theorized to be identical, so the two pulsed alternator current outputs are the same. At the upper portion of FIG. 3, the EM gun current is shown after the output currents from the two paired pulsed alternator subsystems are combined with each other. Here, it can be seen that the small "ripples" found in each of the paired alternator currents are added to each other in the load current. In the FIG. 3 example, the maximum peak-peak ripple is 393,000 Amps (10.2% of the average load current). This is not acceptable for many electromagnetic launcher applications such as rail guns.

Figure 4:
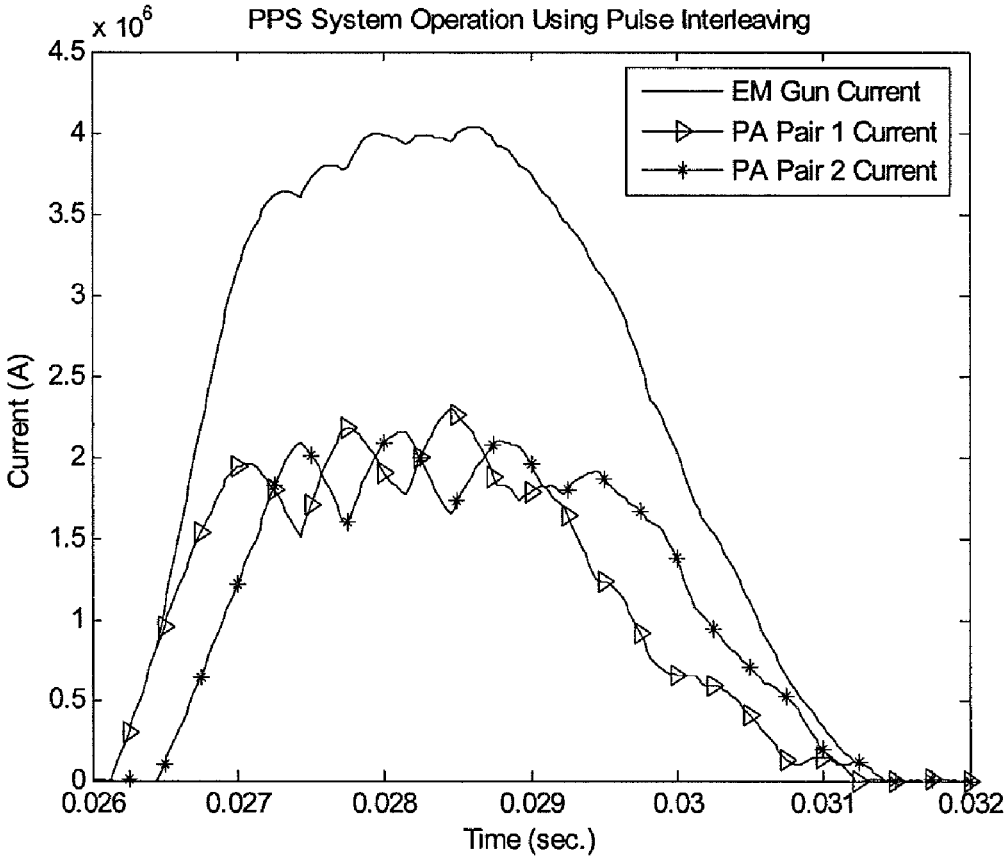
FIG. 4 is a graph of the load and individual pulsed alternator pair currents utilizing a control scheme with interleaved gating signals according to the present invention.

The systems and methods of the present invention address this ripple current problem by employing a control scheme in which the current pulses from different pairs of pulsed alternators are timed so that they are interleaved between each other to provide more current pulses for a given launch time. FIG. 4 shows the simulated current pulses using a control scheme according to the present invention. As an example, the control scheme of FIG. 4 utilizes two pairs of pulsed alternator current sources. Rather than triggering the outputs of each of the pulsed alternators at the same time (as in FIG. 3), the FIG. 4 control mechanism interleaves the pulsed alternator outputs to reduce the ripple effect described above.

Specifically, FIG. 4 shows the individual current outputs from two different sets of counter-rotating pulsed alternators (PA Pair 1 Current, PA Pair 2 Current). The ripples from each of the individual alternator pairs are timed such that the peaks (high current) of the first alternator pair current matches with the troughs (low current) of the second alternator pair. Likewise, the troughs of the first alternator pair align with the current peaks from the second alternator pair. When the gun current after the combination of the two pulsed alternator pair outputs is examined, it is shown that the "ripples" are reduced by the timing and amplitude adjustments of the control system. In this way, the load current can be more closely controlled, and the load current more closely resembles the preferred DC pulse.

In the exemplary embodiment of FIG. 4, the pulses from two pairs of pulsed alternator machines are 45 electrical degrees apart from each other. The maximum load current ripple is 118,000 amps peak-peak (3% of the average load current). Therefore, when compared to the prior system results shown in FIG. 3, the control scheme according to the present invention reduced the maximum peak-peak load current ripple by 275,000 Amps or 70%. The control scheme of the present invention is similarly applicable to systems with more than two pairs of pulsed alternators, and more complicated control schemes that interleave two or more pairs of pulsed alternator currents can be employed within the teachings of the present invention as readily recognized by those skilled in the pertinent art.

Some further details regarding a control scheme in accordance with at least one presently preferred embodiment of the present invention will now be discussed. Prior to discharging current to the load, the control system preferably maintains a constant difference in rotor angular position between the various pulsed alternator pairs. A separate electric motor is connected to each pulsed alternator shaft to charge the pulsed alternator rotors with kinetic energy by spinning them up to high speeds.

A solid state motor drive connected to each charging motor controls the speed and rotor position of each pulsed alternator while rotor speed is increased to store energy and increase the field current prior to the discharge of load current. The charging drives are phase-locked with a phase-locked-loop controller in order to maintain identical speeds for each pulsed alternator and to maintain the required constant rotor angular difference between the pulsed alternator pairs.

The solid state charging drives and charging motors are disengaged and do not control alternator speed and rotor angle during discharge. The load current follows a desired output current profile as current flows from the pulsed alternators through the load converter rectifiers to the load. The control system uses an open loop strategy with a rotor position based lookup table to control the load converter rectifiers. One lookup table is used for each pulsed alternator pair. Each lookup table determines when load converter pulses are produced based on the position of the pulsed alternator rotor.

In a variant alternate embodiment, a closed loop current controller could be used to determine when load converter pulses are produced based on the position of the pulsed alternator rotor and the difference between the desired current profile and the actual load current.

It should be readily understood and appreciated that the embodiments of the present invention as discussed and contemplated herein can be applicable to a very wide variety of contexts. Accordingly, for instance, while the use of two pairs of pulsed alternators has been discussed in some detail hereinabove, it should be understood that three or four or even more pairs of pulsed alternators can readily be employed in the context of the embodiments of the present invention. As such, one or more additional current outputs from one or more additional pairs of pulsed alternators would be combined into the load current.

Preferably, in the context of three or more pairs of pulsed alternators, a delay will be imposed on the third current output with respect to the second current output, while a delay on a fourth current output (if any) will be imparted to the third current output, and so forth. Thus, generally, the control circuit will preferably impart a delay in a current output with respect to an immediately preceding current output.

As discussed heretofore in accordance with at least one embodiment of the present invention, a control system preferably imparts 45 electrical degrees of delay in a second current output when compared to a first current output, when there are two total pairs of pulsed alternators. On the other hand, if there are three total pairs of pulsed alternators, then the control system preferably imparts 30 electrical degrees of delay in the second current output when compared to the first current output; as well as 30 electrical degrees of delay in the third current output when compared to the second current output. Generally, then, given a total number N of pulsed alternators pairs, the control system will preferably impart 90/N electrical degrees of delay in a given current output when compared to an immediately preceding current output.

Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. A pulsed power system, comprising:

a first pair of pulsed alternators configured to generate a first alternating current output at a first frequency;

a second pair of pulsed alternators configured to generate a second alternating current output at the first frequency; and a control system connected to the first and second pairs of pulsed alternators, wherein the control system is configured to:

generate a first single polarity transient pulse from the first alternating current output, wherein the first single polarity transient pulse is at least 100,000 amperes;

generate a second single polarity transient pulse from the second alternating current output, wherein the second single polarity transient pulse is at least 100,000 amperes; and interleave the first and second single polarity transient pulses at the first frequency, wherein the first frequency is less than 1,000 Hertz.

2. The system of claim 1, wherein said control system comprises a rectifier circuit connected to the first and second pairs of pulsed alternators.

3. The system of claim 2, wherein said control system further comprises a rectifier controller connected to said rectifier circuit.

4. The system of claim 1, further comprising a third pair of pulsed alternators connected to the control system and configured to generate a third alternating current output at the first frequency, wherein said control system is further configured to:

generate a third single polarity transient pulse from the third alternating current output, wherein the third single polarity transient pulse is at least 100,000 amperes; and interleave the first, second and third single polarity transient pulses at the first frequency.

5. The system of claim 4, further comprising a fourth pair of pulsed alternators connected to the control system and configured to generate a fourth alternating current output at the first frequency, wherein said control system is further configured to:

generate a fourth single polarity transient pulse from the fourth alternating current output, wherein the fourth single polarity transient pulse is at least 100,000 amperes; and interleave the first, second, third and fourth single polarity transient pulses at the first frequency.

6. The system of claim 1, wherein said control system is further configured to impart a delay in the second single polarity transient pulse with respect to the first single polarity transient pulse.

7. The system of claim 1, wherein said control system is further configured to impart 45 electrical degrees of delay in the second single polarity transient pulse when compared to the first single polarity transient pulse.

8. The system of claim 4, wherein said control system is further configured to impart a delay in the third single polarity transient pulse with respect to the second single polarity transient pulse.

9. The system of claim 4, wherein said control system is further configured to impart:

30 electrical degrees of delay in the second single polarity transient pulse when compared to the first single polarity transient pulse; and 30 electrical degrees of delay in the third single polarity transient pulse when compared to the second single polarity transient pulse.

10. The system of claim 5, wherein said control system is further configured to impart a delay in the fourth single polarity transient pulse with respect to the third single polarity transient pulse.

11. The system of claim 5, wherein said control system is further configured to impart:

22.5 electrical degrees of delay in the second single polarity transient pulse when compared to the first single polarity transient pulse;

22.5 electrical degrees of delay in the third single polarity transient pulse when compared to the second single polarity transient pulse; and 22.5 electrical degrees of delay in the fourth single polarity transient pulse when compared to the third single polarity transient pulse.

12. The system of claim 1, wherein:

said control system is further configured to impart 90/N electrical degrees of delay in a given single polarity transient pulse when compared to an immediately preceding single polarity transient pulse, where N is a total number of pulsed alternator pairs of the system.

13. The system of claim 1, wherein said control system is further configured to adjust an amplitude of said first single polarity transient pulse.

14. The system of claim 1, wherein said system is associated with an electromagnetic rail gun.

15. An electromagnetic rail gun, comprising:

two gun rails;

a first pair of pulsed alternators configured to generate a first alternating current output at a first frequency;

a second pair of pulsed alternators configured to generate a second alternating current output at a first frequency; and a control system connected to the two gun rails and to the first and second pairs of pulsed alternators, wherein the control system is configured to:

generate a first single polarity transient pulse from the first alternating current output, wherein the first single polarity transient pulse is at least 100,000 amperes;

generate a second single polarity transient pulse from the second alternating current output, wherein the second single polarity transient pulse is at least 100,000 amperes; and interleave the first and second single polarity transient pulses at the first frequency, wherein the first frequency is less than 1,000 Hertz.

16. The rail gun of claim 15, wherein said control system is further configured to impart a delay in the second single polarity transient pulse with respect to the first single polarity transient pulse.

17. The rail gun of claim 15, wherein said control system is further configured to impart 45 electrical degrees of delay in the second single polarity transient pulse when compared to the first single polarity transient pulse.

* * * * *